US008297163B2

(12) United States Patent
Cazalieres

(10) Patent No.: US 8,297,163 B2
(45) Date of Patent: Oct. 30, 2012

(54) FIRING DEVICE FOR CLOSE-IN DEFENSE AMMUNITION

(75) Inventor: Jean-Francois Cazalieres, Saint-Germain du Puy (FR)

(73) Assignee: Nexter Systems, Roanne (FR)

( * ) Notice: Subject to any disclaimer, the term of this patent is extended or adjusted under 35 U.S.C. 154(b) by 471 days.

(21) Appl. No.: 12/588,657

(22) Filed: Oct. 22, 2009

(65) Prior Publication Data

US 2010/0147140 A1 Jun. 17, 2010

(30) Foreign Application Priority Data

Oct. 29, 2008 (FR) ..... 08 06022

(51) Int. Cl.
*B64D 1/04* (2006.01)
*F41F 5/00* (2006.01)

(52) U.S. Cl. ..... 89/1.35; 89/37.05; 89/17

(58) Field of Classification Search ..... 89/1.35, 89/37.05, 17
See application file for complete search history.

(56) References Cited

U.S. PATENT DOCUMENTS

| | | | | |
|---|---|---|---|---|
| 1,541,981 | A * | 6/1925 | Lucas | 89/1.1 |
| 2,938,433 | A * | 5/1960 | Jasse | 89/37.05 |
| 3,431,820 | A | 3/1969 | Chinn et al. | |
| 3,745,879 | A * | 7/1973 | Asikainen et al. | 89/37.05 |
| 3,892,163 | A * | 7/1975 | Asikainen | 89/37.05 |
| 4,012,986 | A * | 3/1977 | Germershausen et al. | 89/17 |
| 4,298,914 | A * | 11/1981 | Long | 362/112 |
| 4,724,740 | A * | 2/1988 | Garcia | 89/37.05 |
| 6,912,945 | B2 * | 7/2005 | Ang | 89/37.05 |
| 2010/0269681 | A1 * | 10/2010 | Shipman et al. | 89/42.01 |

FOREIGN PATENT DOCUMENTS

| | | |
|---|---|---|
| DE | 397381 | 6/1924 |
| FR | 2 612 287 | 9/1988 |
| GB | 524185 | 7/1940 |
| GB | 869271 | 5/1961 |

OTHER PUBLICATIONS

Translation and French Search Report issued in corresponding French Application No. 0806022, dated Jul. 7, 2009.

* cited by examiner

*Primary Examiner* — Michelle Clement
(74) *Attorney, Agent, or Firm* — Oliff & Berridge, PLC

(57) ABSTRACT

A firing device for close-in defense ammunition, ammunition incorporating a rigid casing enclosing at least one projectile, casing integral with a base that can be joined by linking means to a firing device base incorporating means to prime the ammunition, device wherein it incorporates a tube capping the ammunition after this ammunition has been fixed onto the firing base, such tube that is itself made integral with the firing base by attachment means, such tube further carrying an articulated bipod enabling the orientation in elevation of the device.

16 Claims, 3 Drawing Sheets

FIRING DEVICE FOR CLOSE-IN DEFENSE AMMUNITION

BACKGROUND OF THE INVENTION

1. Field of the Invention

The technical scope of the invention is that of devices enabling close-in defense ammunition to be fired.

2. Description of the Related Art

Close-in defense ammunition is ammunition to ensure the protection of armored vehicles or fixed structures.

This ammunition is well known. It generally incorporates a rigid casing that encloses at least one projectile. This casing is integral with a base that is itself able to be joined by linking means to a firing base integral with the vehicle. More often than not, this linking is produced by a bayonet-type mounting. Patent FR-2612287 discloses such ammunition (smoke-producing ammunition).

This close-in defense ammunition ensures the defense in the short and medium range of the vehicle or the structure carrying the firing base. Manufacturers have developed a whole range of ammunition to fulfill different functions: smoke-producing, decoy, non-lethal crowd control, explosive . . .

The use of this ammunition is at present limited to vehicle defense. Even if there are fixed firing bases enabling this ammunition to be fired, namely to defend a site, these firing bases generally have a fixed elevation aiming angle.

The suggestion has not yet been made of enlarging the field of use of this close-in defense ammunition for vehicles to an implementation out of the vehicle by an infantryman to ensure, for example, an emergency firing back-up function.

Today, back-up firing support is ensured either by artillery means or by light mortars that have specific ammunition.

However, for operational reasons it may be necessary to ensure such firing back-up functions by a group of infantrymen out of an armored vehicle who don't immediately have such relatively heavy and cumbersome means available to them.

SUMMARY OF THE INVENTION

The aim of the invention is to propose a firing device for close-in defense ammunition that can be rapidly implemented by an infantryman in the field.

The device according to the invention is light, relatively compact, able to rapidly implement out of the vehicle close-in defense means which are already provided in the vehicles. Such a device thus considerably increases the infantrymen's retaliation capabilities.

Thus, the invention relates to a firing device for close-in defense ammunition, ammunition incorporating a rigid casing enclosing at least one projectile, casing integral with a base that can be joined by linking means to a firing device base incorporating means to prime the ammunition, device wherein it incorporates a tube capping the ammunition after this has been fixed onto the firing base, such tube that is itself made integral with the firing base by attachment means, such tube further carrying an articulated bipod enabling the orientation in elevation of the device.

According to a particular embodiment, this device incorporates at least one rod integral with the firing base onto which the tube is mounted able to slide so as to be moved away from the firing base to enable the ammunition to be fastened to the firing base.

It may incorporate two rods parallel to one another.

The firing base will be advantageously integral with a support stand intended to press on the ground.

The stand may incorporate a spade profile to ensure its anchoring in the ground.

According to a particular embodiment, the firing base will be linked to the stand by recoil buffer means.

These recoil buffer means may namely comprise at least one axial limit stop in elastomer positioned between the stand and a cylinder integral with the base.

Furthermore, the recoil buffer means may comprise at least one spring means enabling the stand to swivel with respect to the firing base around an axis perpendicular to the axis of the limit stop.

The firing base will be linked to electrical generation means to ensure the firing of the ammunition.

BRIEF DESCRIPTION OF THE DRAWINGS

The invention will become more apparent from the following description of a particular embodiment, such description being made with reference to the appended drawings, in which.

DETAILED DESCRIPTION OF PREFERRED EMBODIMENTS

Figure 1:
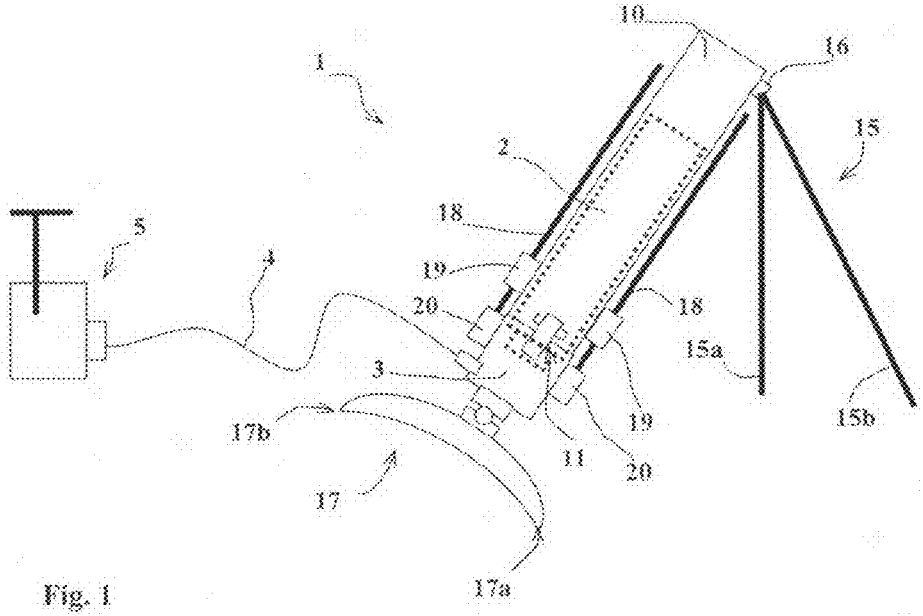
FIG. 1 is a schematic of the device in the firing position.

FIG. 1 shows a firing device 1 according to the invention.

This device enables close-in defense ammunition 2 (shown in dotted lines in this Figure) to be fired.

The device 1 comprises a base 3 incorporating priming means for the ammunition (not shown). These means will comprise an electrical contact that will be linked by a cable (provided with connectors 4*a*, 4*b*) to electrical generation means 5.

Such a generator is well known to somebody skilled in the art. It may incorporate batteries that are kept charged before the mission or else an electrical power generator of the blaster type (classically used equipment in the firing of mines in quarries).

Close-in defense ammunition 2 is well known. This type of ammunition is shown schematically in FIG. 2.

The ammunition incorporates a rigid casing 6 inside which at least one projectile 7 has been put into place. The casing is integral with a base 8 that can be fastened to the firing base 3 of the device by quick linking means (screw or bayonet-type mounting by means of a snug 8*a* on the base 8).

The casing 6 (or base 8) also encloses a propellant charge enabling the projectile 7 to be fired from the casing 6 and a piston 9 separating the propellant charge and the projectile 7.

Contrary to classical ammunition that is fired from gun barrels, close-in defense ammunition thus both incorporates the projectile 7 and the casing 6 enabling the projectile to be fired.

Figure 4:
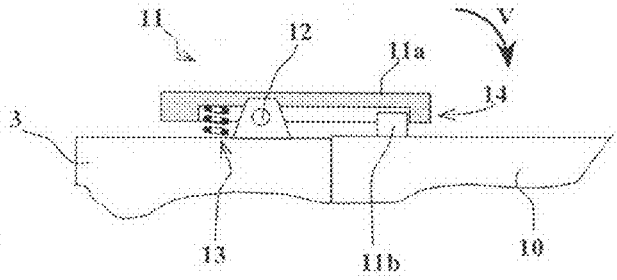
FIG. 4 is a view of one embodiment of means to attach the tube.

The device 1 also comprises a tube 10 that caps the ammunition 2 after this has been fixed onto the firing base 3. The tube 10 may itself be made integral with the firing base 3 by attachment means 11. FIG. 4 shows the structure of attachment means 11 in greater detail. These comprise a lever 11*a* mounted able to tilt on an axis 12 integral with the base 3 and a rim 11*b* integral with the tube 10.

A spring 13 holds the tilted lever in direction V. The lever 11*a* incorporates a lip 14 that engages on the rim 11*b* and ensures the locking of the tube 10 and base 3. Several attachment means 11 may be provided evenly spaced angularly between tube and base.

The tube 10 further carries a bipod 15 articulated on a tongue 16 carried by the end of the tube 10.

Furthermore, the firing base 3 is integral with a support stand 17 intended to press on the ground, stand incorporating a spade profile (here with two blades 17*a*, 17*b*) ensuring its anchoring in the ground.

For firing, the device is positioned with the stand on the ground, one of the spade blades being engaged in the ground. The inclination of the tube 10 with respect to the horizontal may be modified by acting on the angles formed between each element 15*a*, 15*b* of the bipod 15 and the tube 10.

The bipod 15 thus enables the orientation in elevation of the firing device 1. By way of a variant, it will be possible to make the elements 15*a*, 15*b* of the bipod 15 in a telescopic form so as to facilitate the adjustment of the elevation angle.

In accordance with this embodiment of the invention, the device comprises at least one rod 18, here there are two rods parallel to one another, that are made integral with the base by means of lateral supports 20. The tube 10 further incorporates at its lower part, two bearings 19 in which the rods slide 18.

Thus, thanks to the rods 18, the tube 10 is mounted able to slide with respect to the base 3 and may be moved away from the base to enable a piece of ammunition 2 to be fastened to the base 3.

Figure 2:
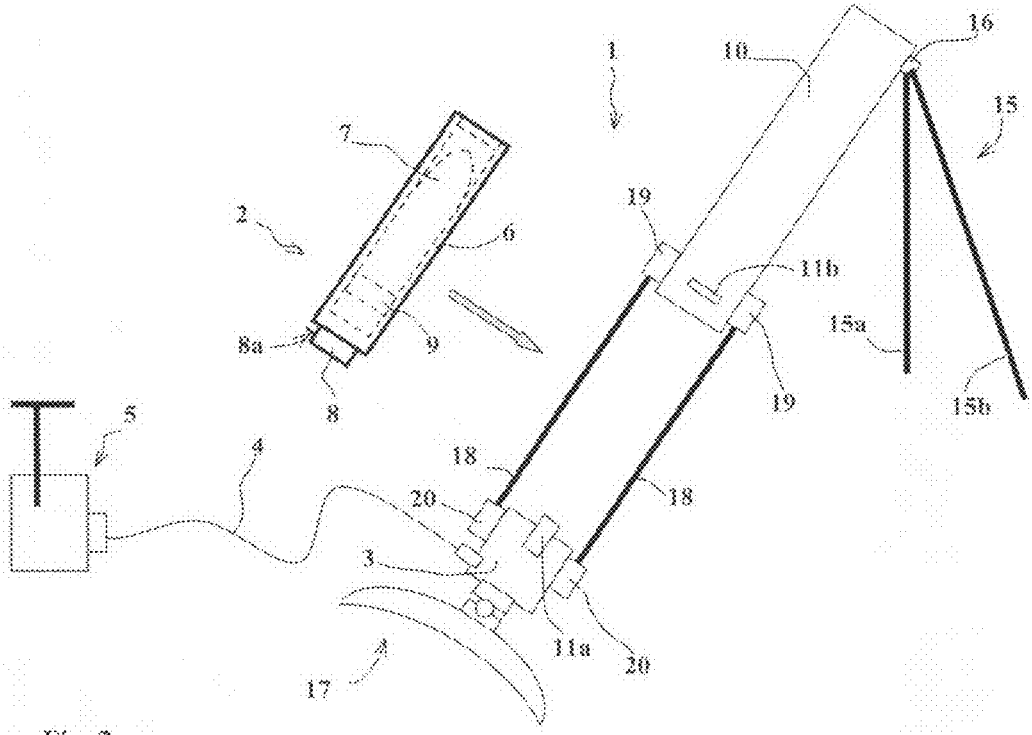
FIGS. 2 and 3 are schematics of two successive steps in the loading of the device.
Figure 3:
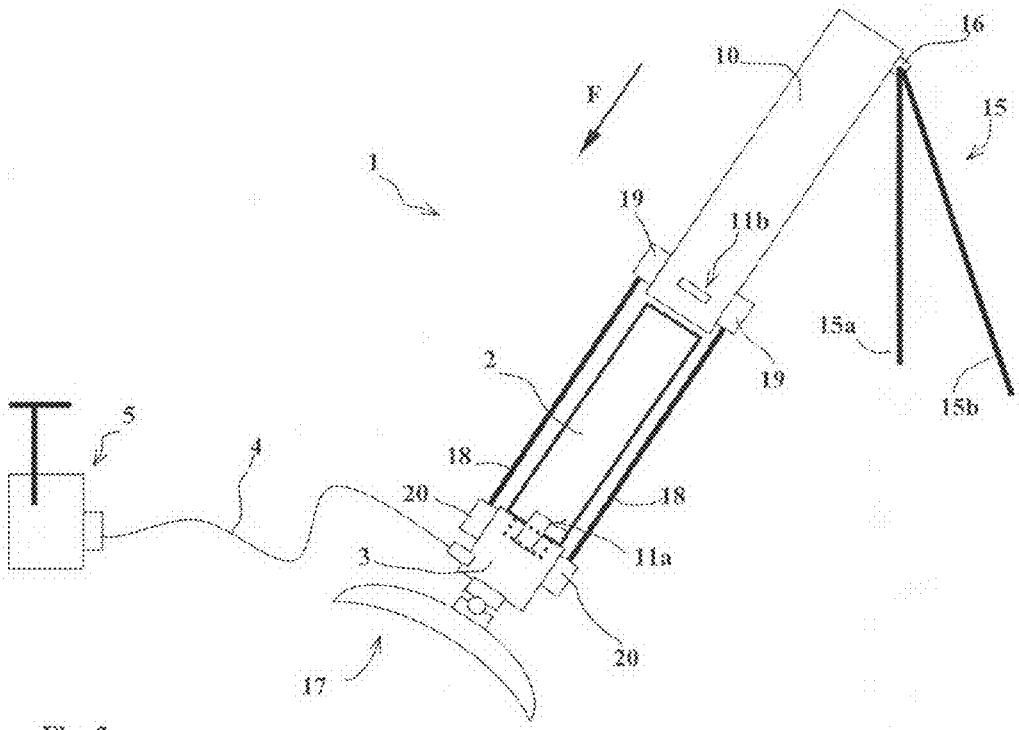

FIG. 2 shows the device 1 with the tube 10 in this reloading position. Once the tube 10 has been moved away from the base 3, it is possible for a piece of ammunition 2 to be fastened to the firing base 3. The tube 10 is then made to slide on its guidance rods 18 in direction F (FIG. 3) until the attachment means 11 are locked into position. The tube 10 thus surrounds the ammunition (FIG. 1). It is oriented at the required elevation angle using the bipod 15*a*, 15*b* and the ammunition is made to fire by means of electrical generator means 5.

Even if the device 1 generally looks like a light mortar, it must be noted that the tube 10 here has no role in guiding the projectile 7 when the ammunition is fired. This guidance is ensured, in fact, by the casing 6 of the ammunition, as when this ammunition is fired from the classical firing bases fastened to the vehicle.

The tube 10 here firstly enables the device to be positioned in elevation in the field and secondly provides the user with a certain protection by channeling away the propellant gases at a distance from him. It also ensures a protection function for the ammunition during the transport phase for the loaded assembly.

According to another characteristic of the invention, the base 3 is linked to the stand 17 by recoil buffer means.

Figure 5A:
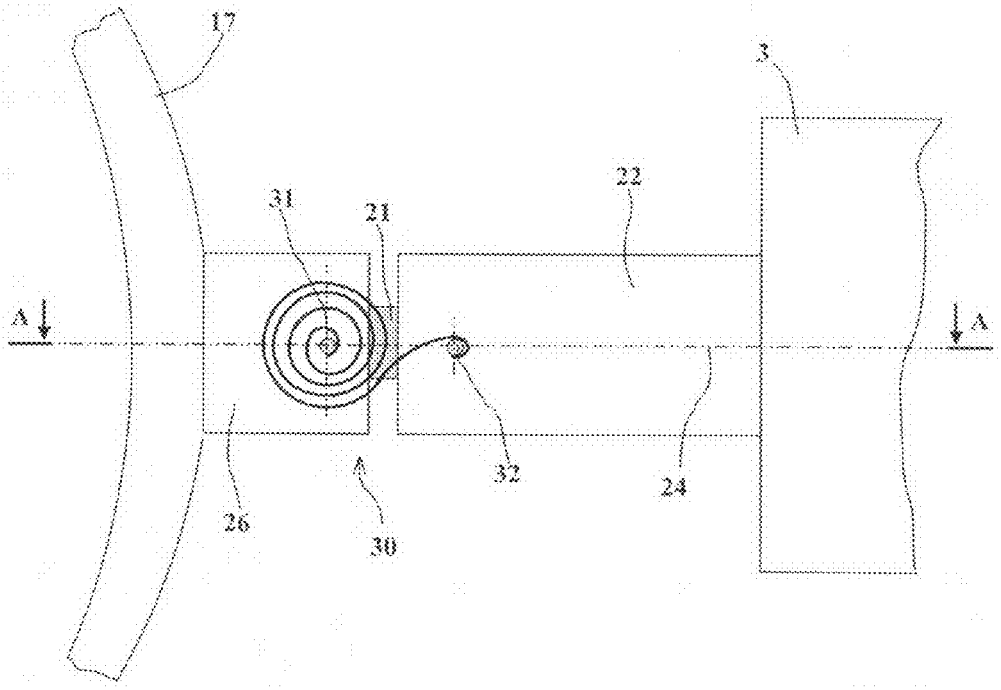
FIGS. 5*a* and 5*b* are detailed views of the buffer means, FIG. 5*b* being a section along plane AA marked out in FIG. 5*a*.
Figure 5B:
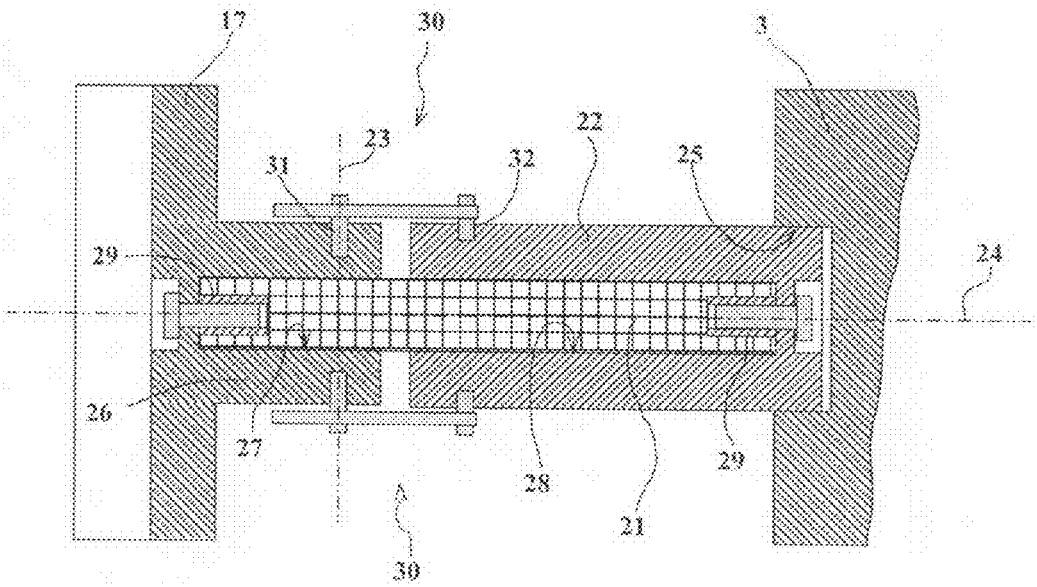

FIGS. 5*a* and 5*b* are intended to precise the structure of this buffer recoil means.

The base 3 is integral with a cylinder 22 that is, for example, screwed into a female thread 25 in the base 3. Furthermore, the stand 17 is integral with another cylinder 26. The two cylinders 26 and 22 are coaxial and each incorporates a bore hole (respectively 27 and 28). An axial limit stop 21 of elastomer is positioned in the two bore holes 27 and 28 and enables the stand 17 to be linked to the base 3. After assembly, there is a free space between the cylinder 22 and the cylinder 26 that enables the limit stop 21 to be compressed during firing.

The axial limit stop 21 incorporates an insert 29 that is a threaded metal bushing. These bushings enable the limit stop to be fastened respectively to the stand 17 and to the cylinder 22 using screws.

The axial limit stop 21 constitutes recoil buffer means that allow by their deformation a limited buffered axial displacement along the axis 24 during firing.

Furthermore, the recoil buffer means comprise at least one spring means 30 that enable the stand 17 to swivel with respect to the base 3 around an axis 23 perpendicular to the axis 24 of the axial limit stop. These spring means are shown here schematically in the form of two spiral springs that are fastened between two pins:

- a first pin 31 integral with the cylinder 26 and which materializes the swivel axis 23, and
- a second pin 32 integral with the cylinder 22.

The springs 30 enable the angular swiveling of the base 3 to be damped with respect to the stand 17. Such an arrangement reduces the bending loads to which the axial limit stop is subjected during firing. Any deterioration of the axial limit stop 21 during firing is thus prevented. Such an arrangement is particularly useful when firing on irregular ground. The flexibility of the springs 30 does not hinder the compression of the axial limit stop 21. It is naturally possible for the spring means 30 to be made in a different form. The spiral may, for example, be integral with the cylinder 22.

Different variants are possible without departing from the scope of the invention. We have seen that it is possible for a bipod 15 to be made with telescopic legs.

It is also possible for a device 1 to be produced that has no guidance rods 18. For this, a tube 10 needs to be provided that can be made integral with the base 3, for example, using attachment means 11. The tube 10 is thus fastened onto the base 3 after the ammunition 2 has been put into place.

The guidance rods, however, have the additional advantage of acting as stiffeners for the firing assembly.

What is claimed is:

1. A firing device for close-in defense ammunition that incorporates a rigid casing enclosing at least one projectile, the casing having a base that is joined to the firing device, the firing device comprising:

an electrical power generator;

a firing base connected to the base of the casing of the close-in defense ammunition;

a tube having an end, the tube being attached to the firing base with a lever; and a bipod carried by the tube and arranged at the end of the tube, enabling an orientation in elevation of the firing device, wherein the tube caps the close-in defense ammunition after the close-in defense ammunition has been fixed onto the firing base, the firing base having an axis and a spring, the lever being mounted on an axis of the firing base and configured to tilt about the axis of the firing base, and the spring configured to hold the lever in a tilted position.

2. The firing device according to claim 1, wherein the device incorporates at least two rods attached to the firing base onto which the tube is mounted and is able to slide so as to be moved away from the firing base to enable the ammunition to be fastened to the firing base.

3. The firing device according to claim 2, wherein the two rods are parallel to one another.

4. The firing device according to claim 1, wherein the firing base is attached to a stand intended to press on the ground.

5. The firing device according to claim 4, wherein the stand has a spade profile for anchoring in the ground.

6. The firing device according to claim 4, wherein the firing base is linked to the stand by a recoil buffer.

7. The firing device according to claim 6, wherein the recoil buffer comprises at least one elastomeric axial limit stop positioned between the stand and the firing base.

8. The firing device according to claim 7, wherein the recoil buffer comprises at least two spiral springs enabling the stand to swivel with respect to the firing base around an axis perpendicular to an axis of the elastomeric axial limit stop.

9. The firing device according to claim 1, wherein the firing base is electrically connected to the electric power generator to ensure the firing of the ammunition.

10. The firing device according to claim 3, wherein the firing base is attached to a stand intended to press on the ground.

11. The firing device according to claim 5, wherein the firing base is linked to the stand by a buffer recoil.

12. The firing The firing device according to claim 8, wherein the firing base is electrically connected to the electric power generator to ensure the firing of the close-in defense ammunition.

13. The firing device according to claim 1, wherein the tube includes a rim that is attached to the tube and extends away from the tube.

14. The firing device according to claim 6, wherein the recoil buffer comprises a first cylinder and a second cylinder, the first cylinder being attached to the firing base and the second cylinder being attached to the stand.

15. The firing device according to claim 14, wherein the first cylinder comprises at least one pin that is attached to the first cylinder, and the second cylinder comprises at least one pin that is attached to the second cylinder.

16. The firing device according to claim 15, wherein at least two spiral springs are fastened between the pin attached to the first cylinder and the pin attached to the second cylinder.

* * * * *